US005802992A

United States Patent [19]

Doncer

[11] Patent Number: 5,802,992

[45] Date of Patent: Sep. 8, 1998

[54] SLUDGE PROCESSOR

[75] Inventor: Alex J. Doncer, Palos Heights, Ill.

[73] Assignee: Alar Engineering Corporation, Mokena, Ill.

[21] Appl. No.: 790,535

[22] Filed: Jan. 30, 1997

Related U.S. Application Data

[62] Division of Ser. No. 530,898, Sep. 20, 1995, Pat. No. 5,660,124.

[51] Int. Cl.[6] ..... F23B 7/00

[52] U.S. Cl. ..... 110/341; 110/258

[58] Field of Search ..... 110/227, 229, 110/258, 293, 341, 257, 228

[56] References Cited

U.S. PATENT DOCUMENTS

| | | | |
|---|---|---|---|
| 2,279,848 | 4/1942 | Unger, Jr. . | |
| 3,744,145 | 7/1973 | Maxwell et al. . | |
| 3,808,701 | 5/1974 | Bachmann . | |
| 4,201,141 | 5/1980 | Teodorescu et al. | 110/227 |
| 4,276,701 | 7/1981 | Takacs et al. . | |
| 4,532,872 | 8/1985 | Andersson | 110/293 |
| 4,576,102 | 3/1986 | Rasmussen et al. | 110/258 |
| 4,726,301 | 2/1988 | Des Ormeaux et al. | 110/227 |
| 4,759,300 | 7/1988 | Hansen et al. | 110/227 |
| 5,020,452 | 6/1991 | Rybak | 110/258 |
| 5,263,267 | 11/1993 | Buttner et al. . | |
| 5,271,163 | 12/1993 | Pikus et al. . | |

FOREIGN PATENT DOCUMENTS

| | | | |
|---|---|---|---|
| 6320132A | 11/1994 | Japan | 110/258 |
| 61385 | 3/1923 | Sweden . | |

*Primary Examiner*—John T. Kwon
*Attorney, Agent, or Firm*—Hill & Simpson

[57] ABSTRACT

A method for drying and heating sludge to remove pathogens and to dry the sludge into a powder form in an elongate housing having an endless chain conveyor inside. The method includes slowly urging solid material from one end of the housing to the other with the conveyor which has outwardly extending scrapers. The method further includes heating the sludge and removing moisture laden air from within the housing with a fan. The stream of solid material is sequentially split, redirected, split, and redirected again when being urged through the housing by the scrapers. The scrapers may include specialized scrapers including plows, inclined paddles, and round rods. Mixing the stream of sludge avoids cold and hot spots, and build up of sludge on a floor of the housing during the process of heating and drying the sludge.

15 Claims, 3 Drawing Sheets

SLUDGE PROCESSOR

This is a division of application Ser. No. 08/530,898, filed Sep. 20, 1995, now U.S. Pat. No. 5,660,124.

BACKGROUND OF THE INVENTION

The present invention relates to an apparatus and method for treating solids in a waste disposal system, particularly in order to dry and to treat sludge from a waste treatment facility.

Sludge from a waste treatment facility is typically wet including the possibility of contamination with pathogens, hazardous materials, or undesirable materials. It is important in the treatment of sludge that water be removed and pathogens or contaminates be killed in the sludge so that the sludge can be transported, disposed of more easily such as in a landfill, incinerated, or reused as fertilizer or fill. Wet sludge or waste material having a significant liquid portion or having pathogens or other contaminates, is more difficult to transport and dispose in a landfill because of its added weight, and its propensity to migrate in the soil when the liquid portion is an undesirable or hazardous waste. A dried and stabilized solid material consisting of a powder-like material would be desirable for transportation, disposal, incineration or recycling. An apparatus and method for drying and treating sludge would be advantageous.

SUMMARY OF THE INVENTION

It is an object of the present invention to provide an apparatus and method for drying and treating sludge to form a dry powder-like material, more easily transported, disposed, incinerated or recycled. It is an object of the invention to provide an apparatus which is reliable and resists breakdowns and blockages in the handling of the solids to be dried and treated. It is an object of the present invention to provide an apparatus and method which dries, sterilizes, and processes the sludge into a powder.

It is an object of the invention to provide a sludge processing apparatus which provides a long maintenance-free run time between cleaning, is energy efficient, and effective. It is an object of the present invention to provide a sludge processor which thoroughly heat sterilizes sludge material without creating cold and warm regions in the sludge which can cause recontamination from pathogens not killed or contaminants not removed.

The object is inventively achieved in that a sludge processing apparatus is provided having an elongated, heated flat bottom conduit with an endless conveyor therein. Partially dewatered sludge from an upstream filter is supplied to an inlet of the conduit, through an air trap to a clod breaker. The clod breaker acts to break up any solid clods contained within the sludge. After passing through the clod breaker, the sludge is deposited on the bottom of the conduit. A conveyor chain is positioned above the bottom of the conduit and uses a pair or more of parallel endless chains having longitudinally spaced apart transverse ribs mounted between the chains. The ribs have depending therefrom, mixing and moving members which come into engagement with the sludge under the chain and agitate the sludge while moving the sludge along the length of the heated conduit toward an exit.

The conduit may have two or more heating zones one of which may be heated to a temperature of 400° to kill all pathogens in the sludge. A blower is provided for extracting moisture laden air from the conduit. As part of the invention, the sludge contacting members depending from the chains have a different geometry from row to row. One row may consist of paddles, angled in one direction, whereas the next row may consist of paddles angled in the opposite direction. Straight rods lining up with the intersections between the paddles break up the mound left by the moving paddles. Additional structures include plows and/or other shapes. The sludge solids are constantly moved side-to-side and back again while breaking up the mounds left by movement of the paddles and plows with the rods. Thus, the sludge is constantly agitated, mixed and remixed as it is at the same time being moved along the length of the conduit.

Because the various paddles and plows are allowed to scrape along the bottom of the conduit, no sludge cake build up occurs that would result in an insulating layer and heat transfer loss. Movement of the conveyor is variable and, in general, exceeds the movement speed of the sludge by a factor determined by the angulation of the paddles and the like. The paddles are angularly adjustable in their mounts. In one particular embodiment, the conveyor might move at the rate of 2–3 feet per minute while the sludge, moving slower, can have a total throughput of about 200–400 pounds per hour for a 35% solids content at the inlet, to a substantially dry, powder-like consistency at the outlet. Other embodiments can be provided having different throughputs, some larger and some smaller than 200–400 pounds per hour. Also, the percentage of solids content can vary from 35%. An air trap can be provided at the outlet.

To make for an energy efficient apparatus and process, the entire conduit is insulated to conserve against heat loss.

DETAILED DESCRIPTION OF THE PREFERRED EMBODIMENTS

Figure 1:
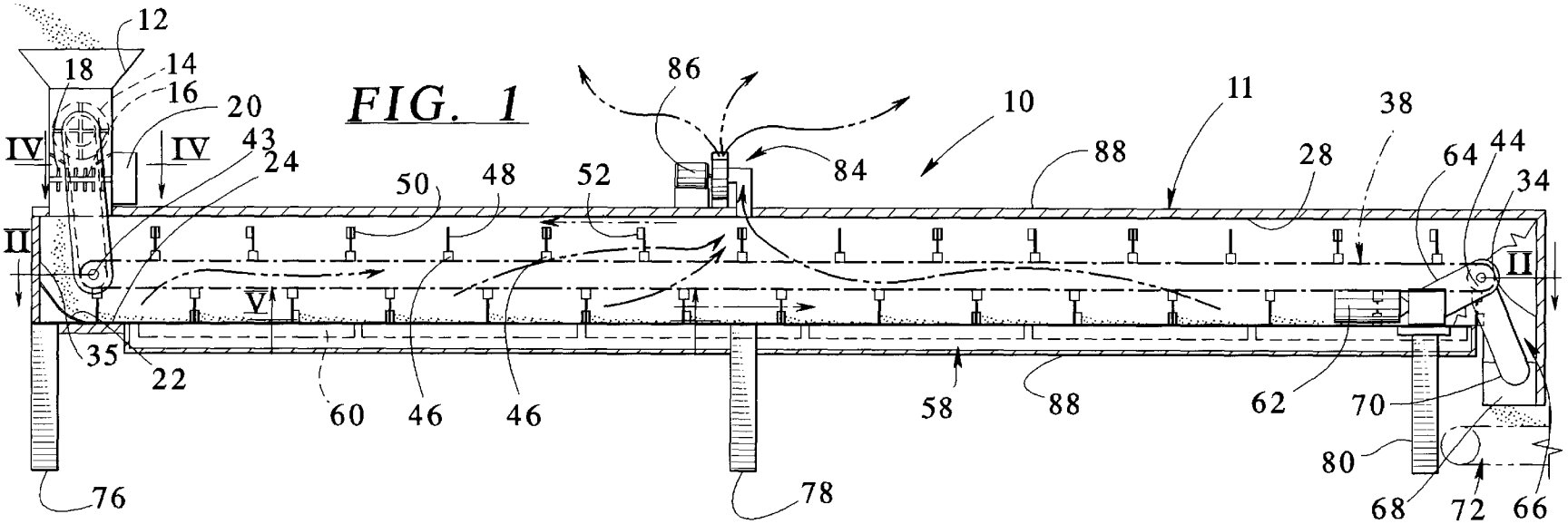
FIG. 1 is a longitudinal sectional view of the apparatus of the present invention.

FIG. 1 illustrates the sludge processing apparatus 10 of the present invention. The apparatus includes a housing 11 for drying and treating wet sludge. The housing 11 includes a wet sludge inlet funnel 12 which channels wet sludge into a rotating air lock valve 14. The air lock valve 14 allows passage of sludge but restricts pass through of air to a limited amount. Below the airlock valve 14 is a clod breaker 16 which has rotating bars 18 driven by a motor 20 to break up and pulverize clods present in the sludge. Once passing through the clod breaker 16, the sludge falls onto and over an arcuate deflector 22 to a bottom wall 24. The bottom wall 24 is a smooth surface.

The housing 11 includes a top wall 28, side walls 30, 32 and end walls 34, 35. Within the housing 11 resides a circulating conveyor 38, formed by two chains 40, 42 arranged in parallel and wrapped around a first set of sprockets 43 and a second set of sprockets 44. Arranged spaced apart and spanning between the chains 40, 42 are spaced, lateral rib plates 46. The rib plates 46 hold a variety of sludge scraper tools such as round rods 48, paddles 50, and plows 52. The scraper tools are arranged to closely pass along the smooth surface of the bottom wall 24 to manipulate sludge collected on the bottom wall 24 and slowly urge the sludge from the wall 22 toward the back wall 34.

Beneath the bottom wall 24 is located a heating compartment 58 having a plurality of heating elements 60 attached to an undersurface of the bottom wall 24 in order to heat the sludge through the bottom wall 24. The heating element 60 can be electric heat, gas heat or any other heating source. Alternately, the heating element can be infrared heat within the housing 11 or caused by the introduction of a warm air or gas into the housing 11 or the compartment 58.

The conveyor 38 is circulated such that the lower side of the conveyor circulates in the direction A as shown in FIG. 1 from left to right, and the upper side circulates from right to left in FIG. 1. The conveyor 38 is driven by a motor 62 connected via a drive chain or belt 64 to the sprockets 44. Adjacent the back wall 34 is a sludge outlet 66 having an air lock valve 68 rotated by a belt 70 and which permits the removal of dried sludge but restricts the entry of air therein. The sludge now in dried and powdered form can be removed via for example a conveyor belt 72 for further processing, loading, or other disposal. The apparatus is shown supported on legs 76, 78, 80. Centrally located on the top wall 28 is an air induced draft fan 84 powered by a motor 86 which draws air in limited quantity through the air locks 14, 68, through the housing 11 and out of the apparatus 10. This allows the removal of moisture laden air from the housing 11 to dry the heated wet sludge.

Figure 2:
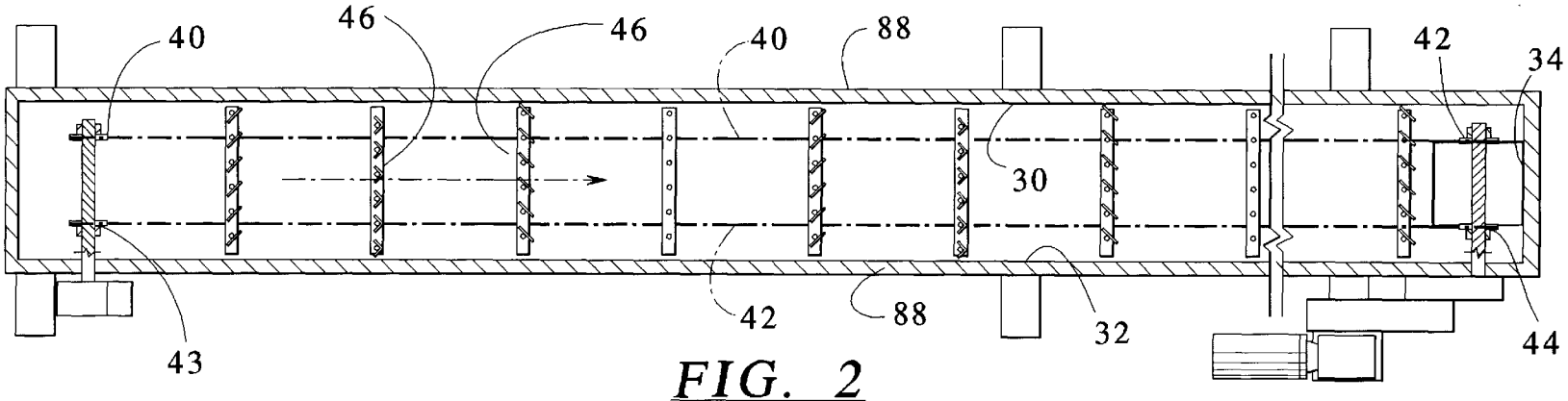
FIG. 2 is a sectional view of the apparatus in FIG. 1 taken generally along line II—II of FIG. 1.
Figure 3:
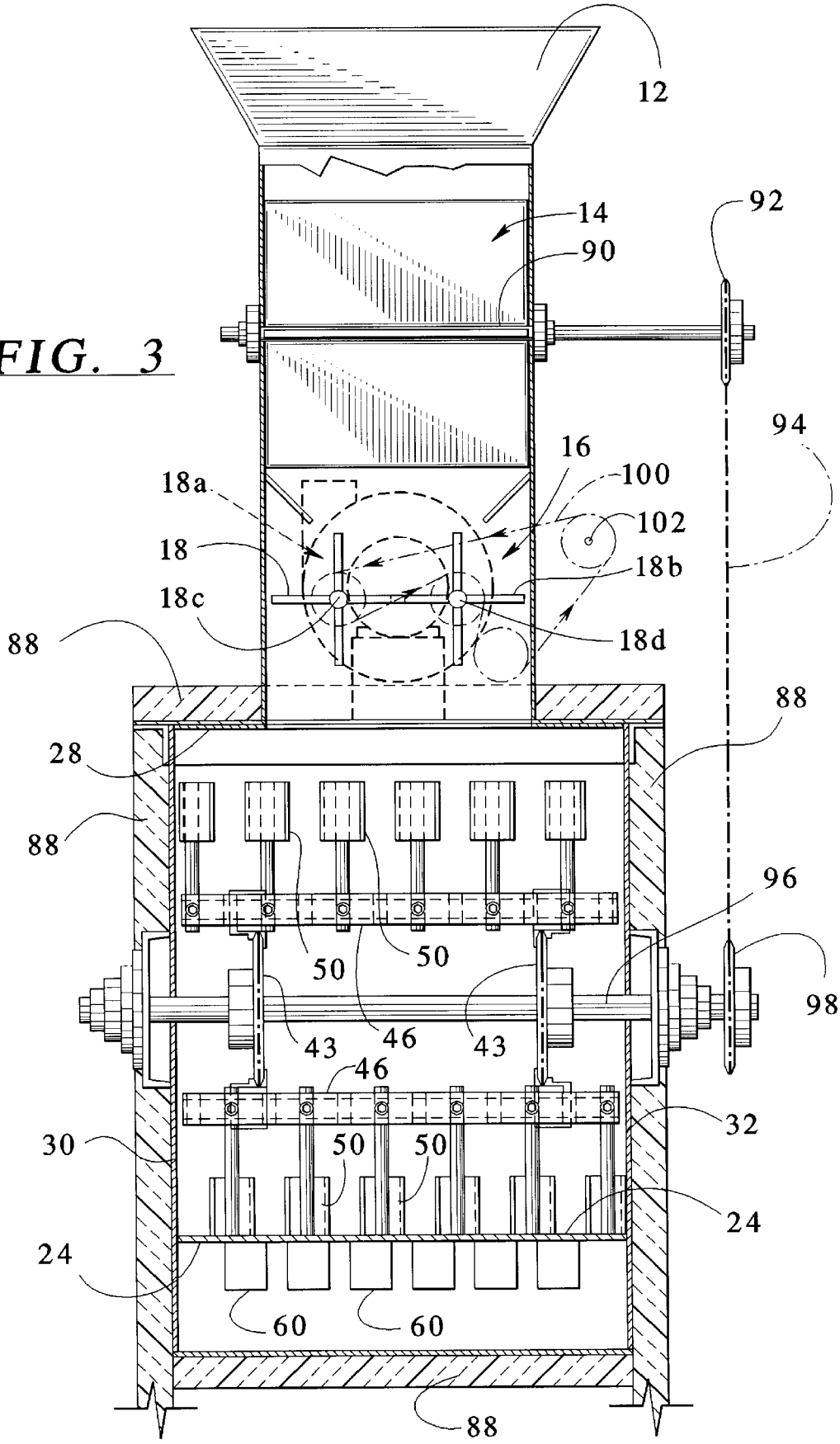
FIG. 3 is a left side view of the apparatus of FIG. 1 with end panels removed for clarity.

As shown in FIGS. 1–3, the housing 11 is insulated on the walls 30, 32, 34, 35 and above the top wall 28 and below the compartment 58 to enclose the housing 11 with insulation 88 to conserve energy.

FIG. 3 illustrates the air lock valve 14 being rotatable on a axle 90 which is driven by a sprocket 92 driven by a chain 94 from the sprocket pair 43 via a shaft extension 96 and secondary sprocket 98. The clod breaker 16 is shown having two groups of rods 18, first rod cluster 18*a* and second rod cluster 18*b* rotatable about shafts 18*c*, 18*d* respectively and spaced apart such that the rods intermesh. The shafts are rotated by a belt 100 driven by a motor 102 shown in phantom to rotate in opposite directions as shown. The intermeshing bars act to break up the clods to pass sludge therebetween.

Also shown in this figure are the heating elements 60 (six shown) which are in close proximity to the bottom wall 24 and which heat sludge held on the bottom floor 24 to dry it and also to kill pathogen and as applicable remove contaminants and undesirables.

Figure 5:
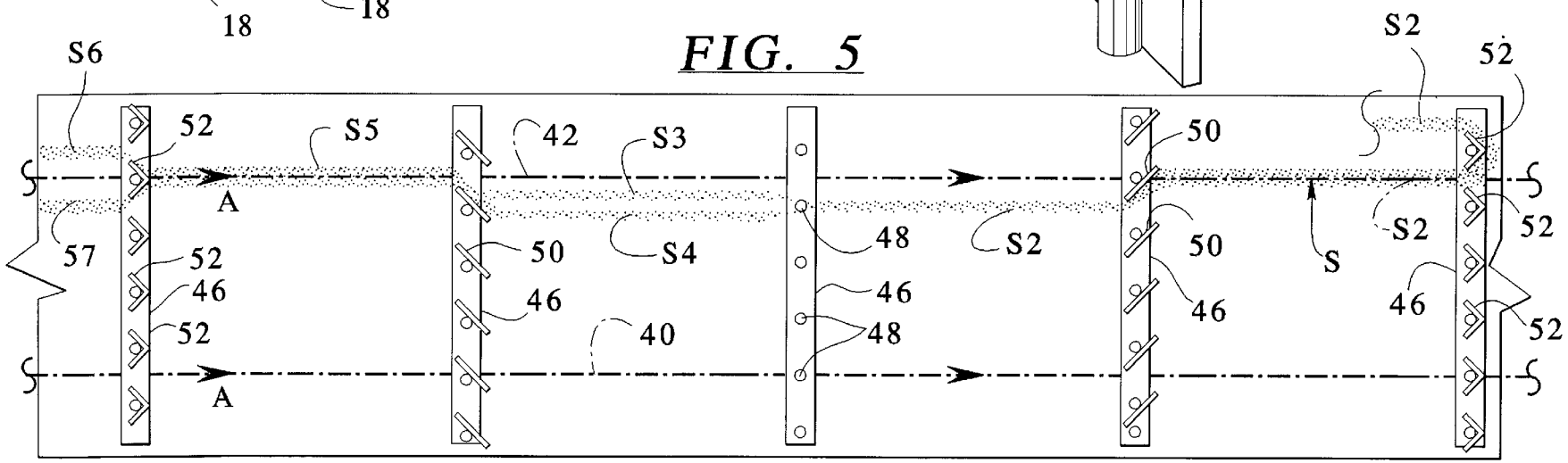
FIG. 5 is a sectional view taken generally along line V—V of FIG. 1.

FIG. 5 shows a portion of a bottom view of the apparatus just above the floor 24. One stream S of sludge is shown for simplicity although many parallel streams would be present across the width of the floor 24. The chains 40, 42 are moving in the direction A and dragging the attached lateral ribs 46 with them. Attached to the ribs 46 are the rods 48, the paddles 50 and the plows 52. As shown in the figure from right to left the stream S moving slowly from left to right is divided into streams S1, S2 by the plow 52. For simplicity only, the stream S1 is shown briefly and discontinued. The stream S2 is next deflected by the inclined paddles 50 to one side. Next, a bar 48 cuts the stream S2 into streams S3, S4 which can be recombined and deflected by oppositely inclined paddles 50 into a stream S5. The stream S5 is then split by an approaching plow 52 into the streams S6, S7. Depending on the sizing and position of the rods 48 and the sizing, positioning and angular orientation of the paddles 50 and the sizing and angulation of the plows 52, these streams can be deflected, combined, split and repeatedly deflected in a wide variety of sequences, for mixing and deflection of sludge to insure a continuous drying and heating throughout the sludge mass for processing.

By continuously mixing and redirecting the sludge, the sludge is heated evenly to avoid cold spots and a build up of sludge on the bottom wall is avoided.

Figure 6:
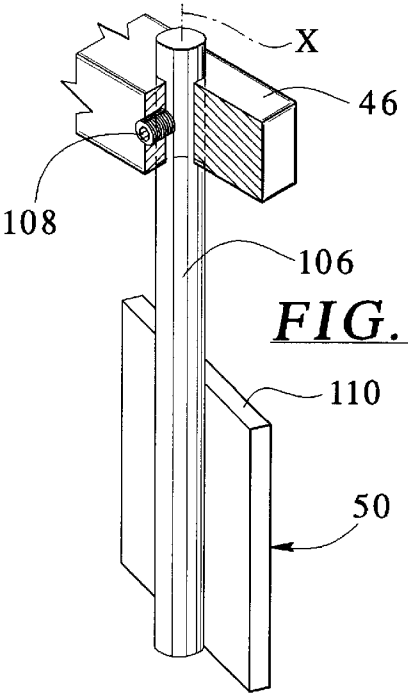
FIG. 6 is an enlarged perspective view, partially in section, of a portion of FIG. 1.
Figure 4:
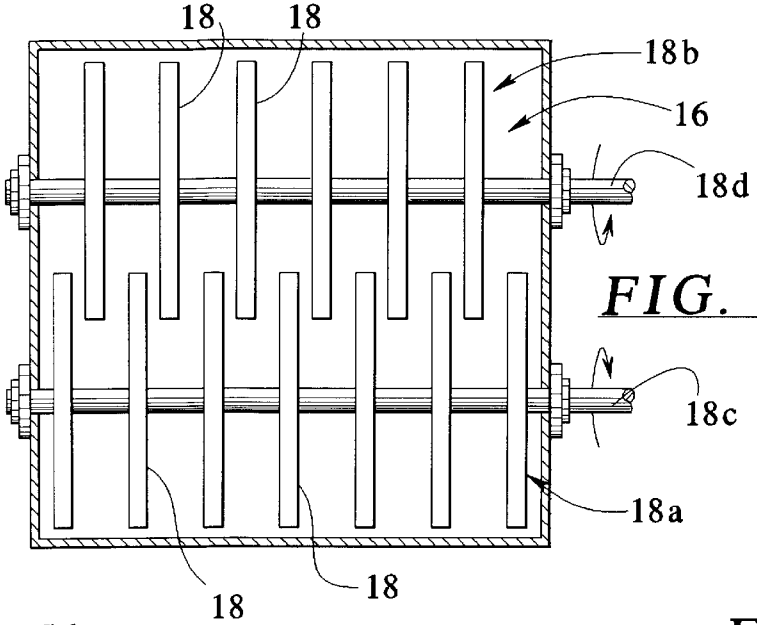
FIG. 4 is a sectional view taken generally along line IV—IV of FIG. 1.

FIG. 6 illustrates a constructional detail of a paddle 50 having a support shaft 106 locked into the rib 46 by a set screw 108. A paddle plate 110 is connected to the shaft 106. By loosening the set screw 108, the vertical positioning of the paddle plate 110 can be adjusted as well as its angular orientation about an axis X of the support shaft 106. The same fastening method is used for the rods 48 and the plows 52.

Because the chains 40, 42 have a degree of flexibility due to their span between sprockets 43, 44 if a solid object becomes wedged beneath a scraper tool or is immoveable, the scraper tool is deflected either upwardly or backwardly to pass the object.

The housing 11 may have two or more controlled heating zones. One of the zones heats the sludge to a temperature of 400° F. to kill all pathogens in the sludge. The conveyor can be set at a rate of 2–3 feet per minute while the sludge, moving more slowly by being dragged by the scraping tools, can have a total throughput of about 200–400 pounds per hour for a 35% solids content at the inlet to a substantially dry, powder-like consistency at the outlet.

Although the present invention has been described with reference to a specific embodiment, those of skill in the art will recognize that changes may be made thereto without departing from the scope and spirit of the invention as set forth in the appended claims.

I claim as my invention:

1. A method for heating a stream of solid material in a stream comprising the steps of:

providing an elongate pathway having an inlet end and an outlet end;

heating said elongate pathway between said inlet end and said outlet end;

introducing said stream of solid material into said inlet end and onto said pathway;

urging said solid material from said inlet end to said outlet end along said pathway and;

repeatedly laterally redirecting said stream by laterally splitting and recombining said stream as said stream is urged along said pathway.

2. A method according to claim 1 providing the further steps of:

laterally deflecting said stream;

laterally deflecting said stream back again; and laterally splitting said stream.

3. The method according to claim 2 wherein said steps of splitting said stream comprise:

splitting said stream into two sub-streams spaced apart by a wide band; and thereafter splitting said stream spaced apart by a narrow band.

4. The method according to claim 1 comprising the further step of continuously removing moisture laden air from within said pathway.

5. The method according to claim 1 comprising the further step of breaking up clods of said stream of solid material at said inlet end before said solid material is deposited in said pathway.

6. The method according to claim 1 wherein the step of repeatedly laterally redirecting said stream further comprises the step of moving scraper tools along said pathway.

7. The method according to claim 1 wherein the step of urging said solid material from said inlet end to said outlet end further comprises the step of moving scraper tools along said pathway.

8. A method of heating a stream of solid material comprising the steps of:

providing an elongate housing having a stream inlet and a stream outlet, and a stream support surface between the stream inlet and outlet;

moving a conveyor between the stream inlet and outlet;

moving the stream through the housing from the inlet to the outlet along the stream support surface with the conveyor;

laterally splitting and recombining the stream with the conveyor as the stream moves along the stream support surface; and heating the stream within the housing.

9. The method according to claim 8 further comprising the step of moving scraper tools extending from the conveyor along the stream support surface.

10. The method according to claim 9 comprising the further step of continuously removing moisture laden air from within the housing.

11. The method according to claim 10 wherein the step of laterally splitting and recombining the stream further comprises the steps of:

laterally deflecting the stream;

laterally deflecting the stream back again; and laterally splitting the stream.

12. The method according to claim 11 further comprising the steps of:

splitting the stream into two sub-streams spaced apart by a wide band; and thereafter splitting the stream spaced apart by a narrow band.

13. The method according to claim 12 comprising the further step of breaking up clods of the stream of solid material at the stream inlet.

14. A method for heating a stream of solid material in a stream comprising the steps of:

providing an elongate pathway having an inlet end and an outlet end;

heating said elongate pathway between said inlet end and said outlet end;

introducing said stream of solid material into said inlet end and onto said pathway;

urging said solid material from said inlet end to said outlet end along said pathway;

repeatedly laterally redirecting said stream as it is urged along said pathway;

laterally deflecting said stream;

laterally deflecting said stream back again; and laterally splitting said stream.

15. The method according to claim 14 wherein the steps of splitting said stream comprise:

splitting said stream into two sub-streams spaced apart by a wide band; and thereafter splitting said stream spaced apart by a narrow band.

* * * * *